US006840328B2

(12) United States Patent
McKee et al.

(10) Patent No.: US 6,840,328 B2
(45) Date of Patent: Jan. 11, 2005

(54) ANTI-EXTRUSION APPARATUS AND METHOD

(75) Inventors: L. Michael McKee, Alvin, TX (US); David M. Eslinger, Broken Arrow, OK (US); Stephen D. Hill, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 109 days.

(21) Appl. No.: 10/304,047

(22) Filed: Nov. 25, 2002

(65) Prior Publication Data

US 2004/0007366 A1 Jan. 15, 2004

Related U.S. Application Data

(60) Provisional application No. 60/395,037, filed on Jul. 11, 2002.

(51) Int. Cl.[7] ..... E21B 33/12

(52) U.S. Cl. ..... 166/387; 166/114; 166/119; 166/136; 166/180; 166/202

(58) Field of Search ..... 166/114, 119, 166/136, 142, 179, 180, 183, 184, 202, 386, 387

(56) References Cited

U.S. PATENT DOCUMENTS

| | | | |
|---|---|---|---|
| 4,252,197 A | 2/1981 | Pringle | |
| 4,501,441 A | 2/1985 | Crews | |
| 4,610,300 A | 9/1986 | Mullins, II et al. | |
| 4,660,646 A | 4/1987 | Blizzard | |
| 4,665,977 A | 5/1987 | Mullins | |
| 4,735,266 A | 4/1988 | Stone et al. | |
| 4,791,991 A | 12/1988 | Morris et al. | |
| 4,836,278 A | 6/1989 | Stone et al. | |
| 4,862,961 A | 9/1989 | Neff | |
| 5,310,004 A | 5/1994 | Leismer | |
| 5,311,939 A | 5/1994 | Pringle et al. | |
| 5,361,836 A | 11/1994 | Sorem et al. | |
| 5,507,341 A | 4/1996 | Eslinger et al. | |
| 5,513,703 A | 5/1996 | Mills et al. | |
| 5,603,511 A | 2/1997 | Keyser, Jr. et al. | |
| 5,701,959 A | 12/1997 | Hushbeck et al. | |
| 5,904,354 A | 5/1999 | Collins | |
| 5,924,696 A | 7/1999 | Frazier | |
| 5,988,276 A | 11/1999 | Oneal | |
| 6,102,117 A | 8/2000 | Swor et al. | |
| 6,131,663 A | 10/2000 | Henley et al. | |
| 6,167,963 B1 | 1/2001 | McMahan et al. | |
| 6,257,339 B1 | 7/2001 | Haugen et al. | |
| 6,425,443 B1 | 7/2002 | Hill et al. | |
| 6,598,672 B2 * | 7/2003 | Bell et al. | 166/118 |

OTHER PUBLICATIONS

"Model 'D' Tension Packer", Petro–Tech Tools, 1999, 8 pages.
"Guiberson G–77 Packer", Halliburton, p. 2–20, no date.
"Guiberson G–77 Packer", A Hydraulic–Set Packer That Saves Rig Time, Halliburton, Jul. 1999, 2 pages.
"TRC–DH Series", Tubing–Retrievable Safety Valve, Schlumberger, pp 13–14, no date.

* cited by examiner

*Primary Examiner*—Zakiya Walker
(74) *Attorney, Agent, or Firm*—Wayne Kanak; Robin Nava; Brigitte L. Echols

(57) ABSTRACT

An apparatus, system, and method useful for discouraging the extrusion of at least one deformable member of a device into a space adjacent to the deformable member when the device is disposed within a borehole and the deformable member extends from the device to the borehole wall involves at least one expandable member disposed upon the device. The expandable member is expandable into the annulus to reduce the width thereof and retractable therefrom to allow movement of the device within and out of the borehole and redeployment of the expandable member. The apparatus, system, and method are particularly suited for limiting the extrusion of packer elements.

40 Claims, 4 Drawing Sheets

ANTI-EXTRUSION APPARATUS AND METHOD

CROSS-REFERENCE TO RELATED APPLICATIONS

This application claims the benefit of U.S. Provisional Application No. 60/395,037, filed Jul. 11, 2002, which is incorporated herein by reference.

BACKGROUND OF THE INVENTION

1. Field of the Invention

The invention relates to methods, apparatus and systems for reducing the size of one or more spaces adjacent to a deformable component of a device. In one embodiment, for example, the invention relates to methods, apparatus and systems for discouraging the extrusion of one or more borehole sealing elements, or members, of a downhole tool into a gap formed between the tool and the borehole. The invention is particularly applicable to packers, including cup and tension set packers.

2. Description of Related Art

Various operations involve the use of devices having one or more deformable members that may undesirably move, or extrude, into a space adjacent to the deformable member. As used throughout this patent, the term "deformable member" means a component, part, or member that may deform under pressure. This often occurs, for example, with devices that are inserted into a borehole, wherein the deformable member is used to form a seal between the device and the borehole wall or other item(s). As used throughout this patent, the term "borehole" means a hole, passageway or area, such as, for example, a wellbore having a casing, within which a device having a deformable member may be deployed. To fit the device into the borehole, the outer width or diameter of the device is often smaller than the inner width or diameter of the borehole. After the device is positioned as desired in the borehole, the deformable member is extended from the device across the annulus formed between the device and the borehole wall, or other item(s), against which it will seal. In such instances, the deformable member may be undesirably forced or extruded into the open annulus adjacent to the deformable member, such as when subject to a differential pressure. Extrusion of the deformable member may not be desirable, such as when it causes the deformable member to become damaged or lose its seal.

This occurs, for example, in the petroleum exploration and recovery industries in operations involving the formation of seals around various types of tools and other equipment in subsurface wells. An example device having one or more deformable members that may be subject to undesirable extrusion is a packer. Packers are often used to secure the position of tubing or other equipment in a borehole, and to isolate the borehole above and below the packer to allow one or more treatment, or operation, to be conducted. A typical packer, which may, for example, be of the inflatable, cup, or tension set type, includes, among other components, one or more elastomeric members (the deformable member) that are extended across an annulus formed between the packer and the borehole wall to form a seal and isolate the borehole above and below itself.

Various solutions have been proposed to address the problem of undesirable extrusion of deformable members. Examples of proposed solutions for preventing or discouraging the extrusion of deformable members in packers and other devices in the petroleum exploration and recovery industries are disclosed in U.S. Pat. Nos. 6,167,963 B1; 6,102,117; 5,988,276; 5,904,354; 5,701,959; 5,603,511; and 5,924,696. These proposed solutions include the use of metal or phenolic pieces and/or garter springs embedded into the elastomeric member, a ceramic seat in which the elastomeric member is located, shoe-type supports held together by c-rings, and split rings or multiple slips. A complete review of each example patent will provide a thorough description of the disclosed design and indicate various limitations thereof.

Thus, there remains a need for methods, apparatus and/or systems for discouraging the undesirable extrusion of a deformable member having one or more of the following capabilities or features: reduces the width, or size, of the gap into which the deformable member may extrude; is removable from the borehole, resettable and reusable; is not deformable; does not hinder removal of the device from the borehole; does not leave substantial debris, or residual material, in the borehole that could obstruct removal of the device from the borehole; has a continuous, or unbroken, outer surface proximate to the deformable member; involves an anti-extrusion device that does not have openings into which the deformable member may extrude; does not significantly increase the length of the device with which it is used; is capable of providing forces upon the deformable member to assist in maintaining its position or seal; assists the deformable member to maintain an isolation seal in a borehole at significant differential pressures, such as, for example, greater than approximately 6000 psi, and high temperatures, such as greater than approximately 300° F.; assists in providing an isolation seal across a large gap in the borehole; assists in reducing the size of the gap sufficient to increase the pressure rating of the device; does not require an expensive rubber embedding process for its manufacture or assembly; and does not rely upon the bonding of rubber for its manufacture or assembly.

BRIEF SUMMARY OF THE INVENTION

In accordance with the present invention, certain embodiments involve an apparatus that is useful for discouraging the extrusion of a deformable member of a device into a space located on at least one side of the deformable member when the device is disposed within a borehole, the deformable member extending between the device and borehole wall. The apparatus includes an annular expandable member disposed upon the device and movable between at least one radially non-expanded position and at least one radially expanded position. In a radially expanded position, the annular expandable member reduces the width of the space on at least one side of the deformable member around the circumference of the device, has a continuous outer surface proximate to the deformable member and assists in asserting forces upon the deformable member to maintain the deformable member in engagement with the borehole wall. When the annular expandable member is in a radially non-expanded position, the device is deliverable into and removable from the borehole without obstruction caused by the annular expandable member. In these embodiments, the annular expandable member is redeployable.

The deformable member may be an elastomeric seal and the device may be a retrievable packer. The annular expandable member may be located adjacent to and up-hole of the deformable member. The annular expandable member may be integral to, or connected with, the deformable member, or may be a separate component. A plurality of annular expandable members positioned on at least one among the opposing sides of the deformable member may be included.

The annular expandable member may include at least one spring-acting member, such as, for example, a wave spring, compression spring or bellville washer. A ramped ring upon which the spring-acting member is movable between radially non-expanded and radially expanded positions may be included. A mandrel upon which the deformable member and the annular expandable member are carried, and a centralizer associated with the annular expandable member which is capable of generally maintaining the annular expandable member centered upon the mandrel may be included. The apparatus may include a load ring associated with the annular expandable member and capable of asserting force upon the deformable member to maintain the deformable member in engagement with the borehole wall.

The annular expandable member may experience insubstantial permanent structural deformation after being moved between radially non-expanded and radially expanded positions. The annular expandable member may be disposed in a flexible cover.

Various embodiments of the invention involve an anti-extrusion apparatus useful for reducing the width of an extrusion gap adjacent to a seal member of a downhole device deployed in a borehole, the seal member extending between the downhole device and the borehole wall. The anti-extrusion apparatus includes a redeployable spring-acting member disposed upon the downhole device, the spring-acting member being movable between a radially non-expanded position and a radially expanded position. In the radially expanded position, the spring-acting member reduces the width of the extrusion gap on at least one side of the seal member around the circumference of the downhole device and assists in imparting forces upon the seal member to maintain the seal member in engagement with the borehole wall. In the radially non-expanded position, the spring-acting member is movable within and from the borehole without obstructing movement of the downhole device.

A load ring associated with the spring-acting member and capable of asserting force upon the seal member to maintain the seal member in engagement with the borehole wall may be included. A ramped ring upon which the spring-acting member is movable between the radially non-expanded position and the radially expanded position may be included. Two spring-acting members may be included. The spring-acting member may include at least one wave spring. The spring-acting member may have a continuous outer surface proximate to the seal member. The seal member may be an elastomeric seal and the downhole device may be a packer.

Certain embodiments of the invention involve a downhole tool capable of sealing an annulus formed between the downhole tool and a borehole wall in the presence of a pressure differential in the annulus. The downhole tool includes an inner mandrel deployable into the borehole, at least one elastomeric member, and at least one annular expandable member carried upon the inner mandrel. The elastomeric member is extendable from the downhole tool and sealingly engageable with the borehole wall. The annular expandable member is extendable into the annulus around the circumference of the downhole tool, reducing the width of the annulus proximate to the elastomeric member to discourage extrusion thereof into the annulus. The annular expandable member is also capable of assisting in asserting forces upon the at least one elastomeric member to maintain the at least one elastomeric member in sealing engagement with the borehole wall. The annular expandable member is further capable of being retracted from the annulus to allow movement of the downhole tool within and from the borehole, and the annular expandable member is redeployable.

The differential pressure in the annulus may be at least approximately 6000 psi. The annular expandable member may have a continuous outer surface sufficient to discourage extrusion of the elastomeric member into the annular expandable member during normal operations. The annular expandable member may include a spring-acting member.

Some embodiments of the invention involve a method for discouraging the extrusion of a seal member of a device into an annulus formed between the device and the wall of a borehole, the seal member extendable from the device across the annulus and sealingly engageable with the borehole wall, the device also carrying an annular expandable member. The method includes applying compressive force to the annular expandable member, causing the annular expandable member to extend into and reduce the width of the annulus on at least one side of the seal member around the circumference of the device. The annular expandable member asserts force upon the seal member to assist in maintaining the seal member in engagement with the borehole wall. Compressive force is removed from the annular expandable member, causing the annular expandable member to retract from the annulus and allow movement of the device within and out of the borehole, and enabling redeployment of the annular expandable member and seal member. If desired, the device may be repositioned in the same or another borehole. The seal member and annular expandable member may be redeployed.

Accordingly, the present invention includes features and advantages which are believed to enable it to advance the technology associated with discouraging the extrusion of a deformable member. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF THE INVENTION

Figure 1:
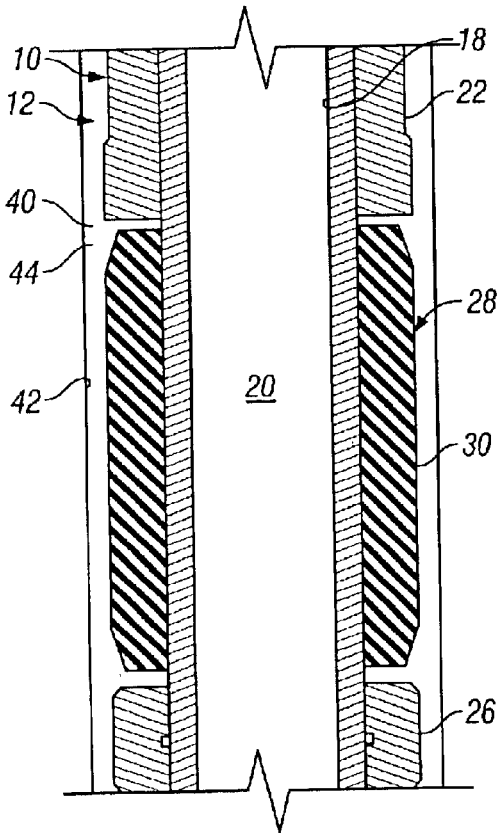
FIG. 1 (Prior Art)
FIG. 1 is a partial cross-sectional view of a conventional, or prior art, tension or compression-set mechanical packer disposed in a borehole.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention", and variations thereof are not intended to mean the claimed invention of any particular appended claim or claims, or all of the appended claims. These terms are used to merely provide a reference point for subject matter disclosed herein. The subject or topic of each such reference is thus not necessarily part of, or required by, any particular claim(s) merely because of such reference. Accordingly, the use herein of the terms "invention", "present invention", and variations thereof is not intended and should not be used in arriving at the construction or scope of the appended claims.

For background purposes, reference will now be made to FIG. 1, wherein a downhole tool 10 is shown. The illustrated downhole tool 10 is a mechanical packer 12. The packer 12 is shown including an inner mandrel 18 carrying an upper gage ring 22, lower gage ring 26, and a deformable member 28, as are or become known. The deformable member 28 of this example is an elastomeric member 30. In some embodiments, there may be numerous such components. Thus, the references herein to a component in the singular tense includes embodiments having one or more such component(s) (e.g. the term "elastomeric member" means one or more elastomeric member).

In the example shown, the axial position of the elastomeric member 30 and lower gage ring 26 are fixed upon the inner mandrel 18. However, the inner mandrel 18, the elastomeric member 30, and lower gage ring 26 are axially movable relative to the upper gage ring 22. This enables setting of the illustrated packer 12, as is or becomes known. It should be understood that these components of the packer 12, if included, may take any other suitable form and configuration. Moreover, the packer 12 may include different or additional components.

The inner mandrel 18 of the illustrated example includes a conduit 20 in fluid communication with the bore of a tubing (not shown), which is used to convey the tool 10 into a borehole 40. The tubing (not shown) may be coiled tubing, or any other suitable tubing or component(s). Thus, as used herein and throughout the various portions of this patent, the term "tubing" and variations thereof means coiled tubing, jointed drill string elements, or any other desirable component(s) capable of deploying a tool, or other device, into a borehole.

Still referring to FIG. 1, the illustrated packer 12 is shown in a run-in-hole position in the borehole 40. While the borehole 40 of FIG. 1 appears vertically-oriented, the present invention is not limited to any particular orientation of the borehole 40. For example, the tool 10 may be used in a borehole 40 that is non-vertical, such as a "horizontal" or "deviated" well.

In typical use, the exemplary packer 12 is inserted into the borehole 40 via the tubing (not shown). To enable such insertion, the outer diameter of the packer 12 is smaller than the inner diameter of the borehole 40. When the packer 12 is moved into the borehole 40, an area, or annulus, is thus generally formed between the packer 12 and the borehole wall 42. This area, or annulus, is referred to herein as the "extrusion gap" 44. After the desired depth of the packer 12 in the borehole 40 is achieved, the elastomeric member 30 is expanded to form a seal between the packer 12 and the borehole wall 42, creating isolated zones in the borehole 40 above and below the elastomeric member 30. These borehole zones are referred to herein as the upper and lower zones 46, 48, respectively (see e.g. FIG. 3).

Specifically with reference to the packer 12 of FIG. 1, the elastomeric member 30 is expanded by imparting axial forces upon it, as is known in the art. For example, the upper gage ring 22 may be secured to the borehole wall 42. The inner mandrel 18, elastomeric member 30, and lower gage ring 26 are then moved upwardly relative to the fixed upper gage ring 22. This action effectively squeezes the elastomeric member 30 between the upper and lower gage rings 22, 26, causing it to expand. The elastomeric member 30 is thus compressed under axial forces, causing it to expand outwardly into the borehole 40 to ultimately engage and form a seal with the borehole wall 42, as is or becomes known.

If the pressure in the upper and lower zones 46, 48 differs, the elastomeric member 30 is subject to a pressure differential, which may cause the elastomeric member 30 to extrude or deform into the extrusion gap 44 adjacent to it. In such instances, the elastomeric member 30 may become damaged and/or lose its seal with the borehole wall 42, potentially compromising or disrupting isolation of the upper and lower zones 46, 48. The ability to maintain isolation of the zones 46, 48 may thus be dependent upon the size or width of the extrusion gap 44 adjacent to the elastomeric member 30.

Further details of the components, arrangement, and operation of the packer 12, as well as alternate components and arrangements therefore, are, or will be, known to persons skilled in the art, and can be found in various patents and printed publications, such as, for example, U.S. Pat. Nos. 6,257,339; 4,862,961; and 4,665,977, each of which is incorporated herein by reference.

The above description of the illustrated packer 12 and its operation is provided for illustrative purposes only and is not limiting upon the present invention. Moreover, the present invention, embodiments of which will be described below, is not limited to use with packers, but can be incorporated in, or associated with, any tool, or device, having a deformable member disposable across an area, or which is used to separate two or more zones. Thus, the type, operation, components and arrangement of the packer 12, or other tool 10, and the environment within which it is used are in no way limiting upon the present invention.

Figure 2:
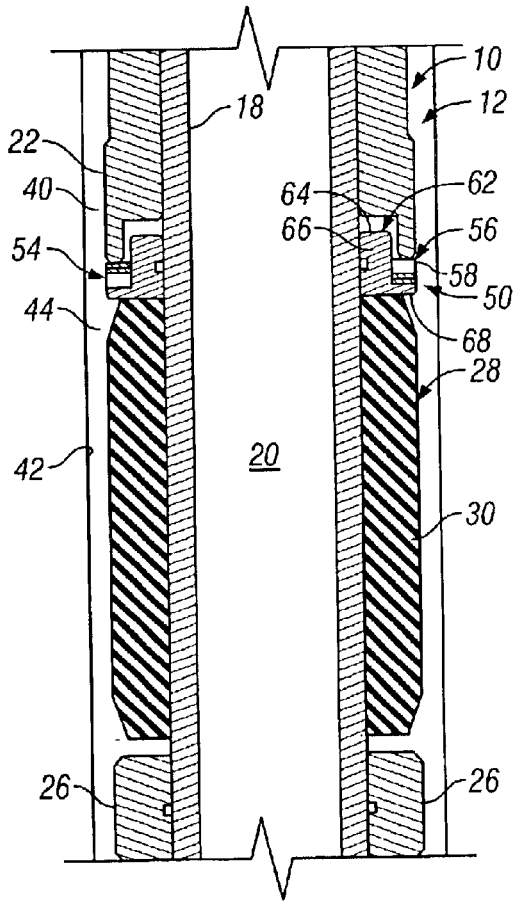
FIG. 2 is a partial cross-sectional view of an embodiment of an anti-extrusion device having a wave spring form of expandable member in accordance with the present invention shown used with a packer in a borehole.

Referring now to FIG. 2, an example anti-extrusion device 50 in accordance with the present invention is shown associated with the tool 10. The illustrated anti-extrusion device 50 includes an expandable member 54 that is expandable into the extrusion gap 44 to reduce the width, or size, of the gap 44 on at least one side of the deformable member 28.

Figure 3:
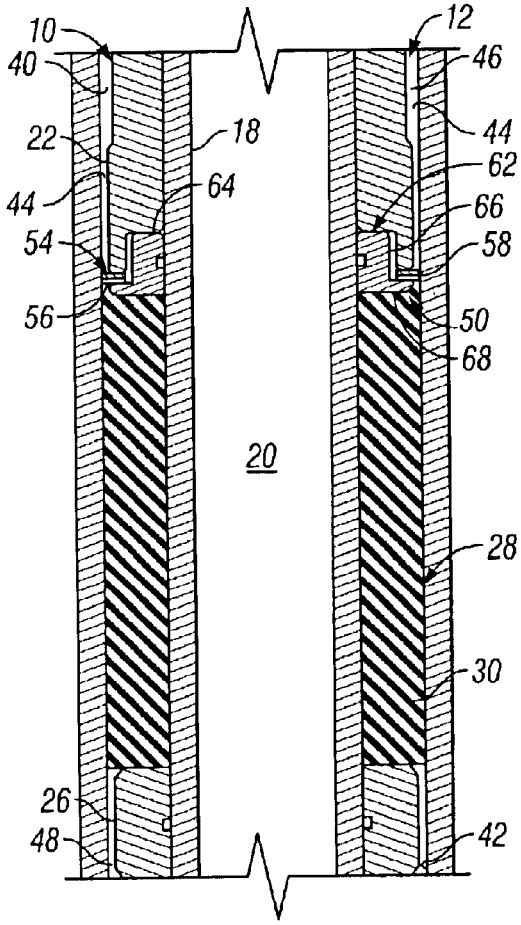
FIG. 3 is a partial cross-sectional view of the embodiment of FIG. 2 showing the expandable member in an expanded position.

The illustrated expandable member 54 is located adjacent to and up-hole of the elastomeric member 30 and, as shown in FIG. 3, is expandable entirely across the extrusion gap 44, thus abutting, or engaging, the borehole wall 42. This embodiment is thus capable of closing off or blocking the extrusion gap 44 up-hole of the elastomeric member 30 and may be desirable, for example, when the upper zone 46 of the borehole 40 has, or is expected to have, a lower pressure than the lower zone 48. It should be understood, however, that the expandable member 54 may instead extend only partially into, or across, the extrusion gap 44, reducing its width. Further, if desired, the anti-extrusion device 50 may include multiple expandable members (not shown) on either side, or both sides, of the deformable member 28. For example, it may be desirable to locate the expandable member 54 on the downhole side of the deformable member 28 when the pressure in the upper zone 46 is expected to be higher than the pressure in the lower zone 48.

Figure 4:
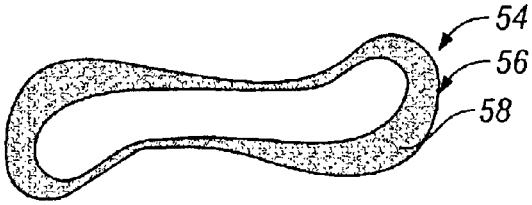
FIG. 4 is a perspective view of an example wave spring that may be used in one or more embodiment of an anti-extrusion device in accordance with the present invention.
Figure 6:
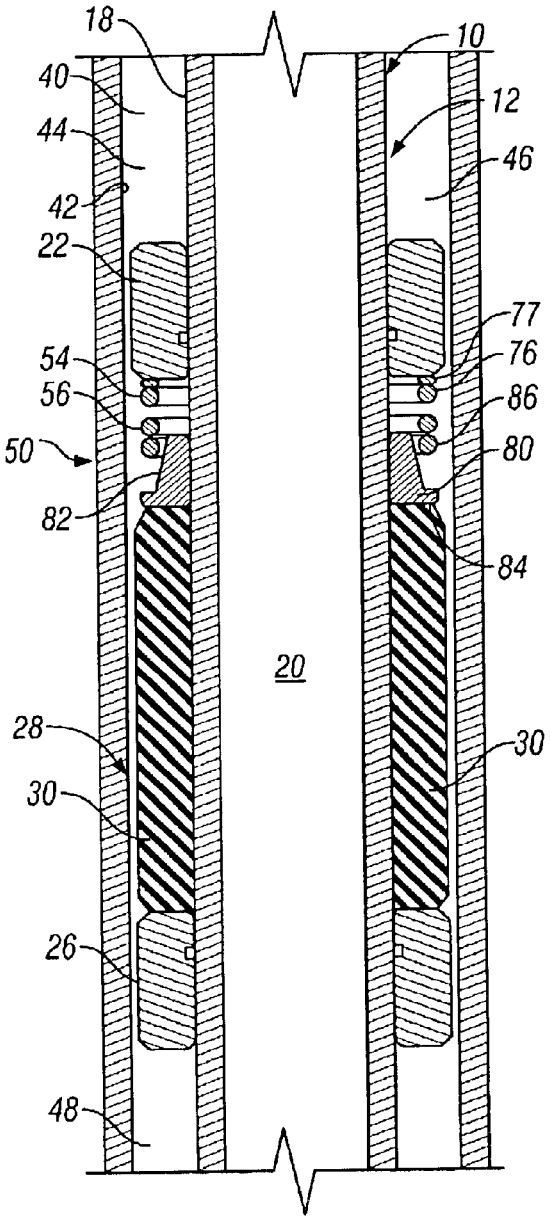
FIG. 6 is a partial cross-sectional view of another embodiment of an anti-extrusion device having a compression spring form of expandable member in accordance with the present invention shown used with a packer in a borehole.

Referring specifically to FIG. 2, the expandable member 54 may take any suitable form and configuration. For example, the expandable member 54 may be an annular spring-acting member 56 that is radially expandable into the extrusion gap 44 around the circumference of the tool 10 after the tool 10 is positioned as desired in the borehole 40. In the embodiment shown, the expandable member 54 is a spring-acting member 56 disposed around the inner mandrel 18 between the elastomeric member 30 and the upper gage ring 22. The illustrated spring-acting member 56 is a wave spring 58, as is or becomes known. An example embodiment of a wave spring 58 is shown in FIG. 4. However, the present invention is not limited to the inclusion of a wave spring 58. Any other suitable expandable member 54 may be used. For example, the expandable member 54 may include one or more bellville washers (not shown) or compression spring 76 (FIG. 6).

The example expandable member 54 of FIGS. 2 and 3 is a separate component of the anti-extrusion device 50. However, the expandable member 54 may instead be molded into, integral with, or attached to the deformable member 28, or another component. Further, the illustrated expandable member 54 has a continuous, or unbroken, outer surface proximate to the deformable member 28 to prevent extrusion of the deformable member 28 into the expandable member 54 itself. If desired, the expandable member 54 may be contained in, or include, a cover or carrier (not shown), such as a flexible elastomeric, or high-elasticity rubber, sheath. Such configuration may be desirable, for example, to assist in preserving and/or excluding debris from the expandable member 54 during use, providing a continuous outer surface of the expandable member 54, or any combination thereof. However, the continuous outer surface and use of a cover may not be included in some embodiments of the invention.

Referring again to FIG. 2, the expandable member 54 is shown associated with a carrier 62. The illustrated carrier 62 is a piston-shaped load ring 64 engaged around the inner mandrel 18 in a fixed axial position. The load ring 64 includes a body 66 and a shoulder 68. The body 66 carries the wave spring 58, while the shoulder 68 engages, and applies axial forces to the elastomeric member 30. However, the carrier 62 need not be a load ring 64 having such features, but can be any suitable device for carrying the wave spring 58 and/or engaging the elastomeric member 30. Yet further, if desired, a different component may be used for engaging the deformable member 28. Moreover, a carrier 62 or other such component(s) may not be included in some embodiments.

Figure 5:
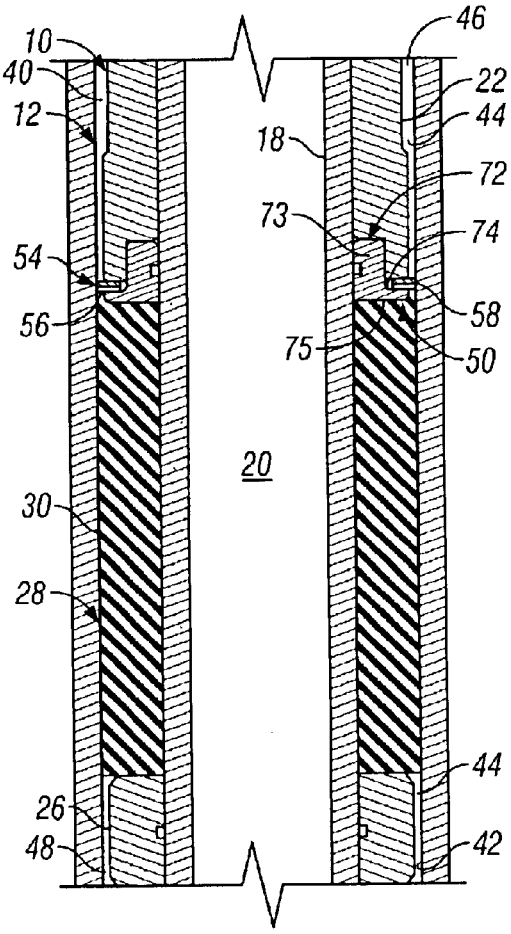
FIG. 5 is a partial cross-sectional view of an embodiment of an anti-extrusion device that includes a centralizer in accordance with the present invention.

Now referring to FIG. 5, the anti-extrusion device 50 may include a centralizer 72 useful for assisting in centering the expandable member 54 on the tool 10. In the particular embodiment shown, the centralizer 72 includes a body 73 and shoulder 75 and is used in place of the carrier 62. The body 73 carries the wave spring 58, while the shoulder 75 engages and applies axial forces to the elastomeric member 30. The example centralizer 72 also includes a relatively steep-angled cone surface 74, which assists in maintaining the wave spring 58 centered on the inner mandrel 18 throughout operations. However, the centralizer 72 can take any other suitable form and configuration. For example, the centralizer 72 may be used in addition to a carrier 62, or may be part of another component. Moreover, a centralizer 72 may not be included in some embodiments.

Referring to FIG. 3, the expandable member 54 may be expanded into the extrusion gap 44 with any suitable technique. For example, when the expandable member 54 is a spring-acting member 56, axial forces may be used to expand and allow the retraction of the spring-acting member 56. In the particular embodiment shown, axial forces are placed upon the wave spring 58 when the inner mandrel 18 is moved relative to the anchored upper gage ring 22 to expand the elastomeric member 30 and set the packer 12. As the inner mandrel 18 is drawn upwardly, the carrier 62 and wave spring 58 are sandwiched between the upper gage ring 22 and elastomeric member 30. The wave spring 58 is compressed, causing its outer diameter to expand around its circumference, the wave spring 58 thus extending into the extrusion gap 44. Since the exemplary wave spring 58 has a continuous outer surface (as shown in FIG. 4), the elastomeric member 30 should not extrude into the wave spring 58.

In another aspect of the invention, the anti-extrusion device 50 may, if desired, be designed to assist the elastomeric member 30 in maintaining its position, or seal, in the borehole 40. In the embodiment of FIG. 3, for example, when the wave spring 58 is expanded and the elastomeric member 30 is set, the wave spring 58 maintains spring force upon the carrier shoulder 68, which, in turn, applies generally continuous axial force upon the elastomeric member 30. Such forces maintained on the elastomeric member 30 by the anti-extrusion device 50 may be sufficient to retain the elastomeric member 30 in a set, or sealingly engaged, state during typical use conditions. In an exemplary embodiment, the anti-extrusion device 50 may be designed to assist in maintaining an isolation seal at the elastomeric member 30 at high differential pressures, such as over 6000 psi, and high temperatures, such as over 300° F., or within large extrusion gaps 44 at lower temperatures and pressures. It should be understood, however, that this aspect may not be included in some embodiments.

Referring again to FIGS. 2 and 3, in yet another aspect of the invention, the expandable member 54 may, if desired, be retractable from an expanded to a non-expanded position, so as to allow movement of the tool 10 within or out of the borehole 40 and/or redeployment of the tool 10 and expandable member 54 within the same or other boreholes 40. In the embodiment shown, for example, when the packer 12 is disengaged from the borehole wall 42 by lowering the inner mandrel 18, axial forces on the expandable member 54 are released. The expandable member 54 moves to its original, or a substantially non-expanded, state, thus retracting out of the extrusion gap 44 and removing axial forces placed upon the elastomeric member 30 thereby. In a non-expanded state, the expandable member 54 should not catch on the borehole wall 42 or otherwise hinder the mobility of the tool 10. Further, the exemplary anti-extrusion device 50 should leave no debris or residual material in the borehole 40 that could disrupt movement of the tool 10 therein. The tool 10 is thereafter movable within and from the borehole 40, and redeployable without obstruction caused by the anti-extrusion device 50.

If desired, the anti-extrusion device 50 may be designed so that the expandable member 54 in a non-expanded state is set back from the outermost diameter of the tool 10, such as, for example, the outer diameter of the upper and/or lower gage rings 22, 26. In such instance, other components of the tool 10 will generally protect the expandable member 54 in a non-expanded state from damage during movement into, within, and out of the borehole 40. The expandable member 54 may thereafter be redeployed by repeating the expansion process as described above or another suitable technique. It should be understood, however, that retraction and redeployment of the expandable member 54 may not be included in some embodiments.

Figure 7:
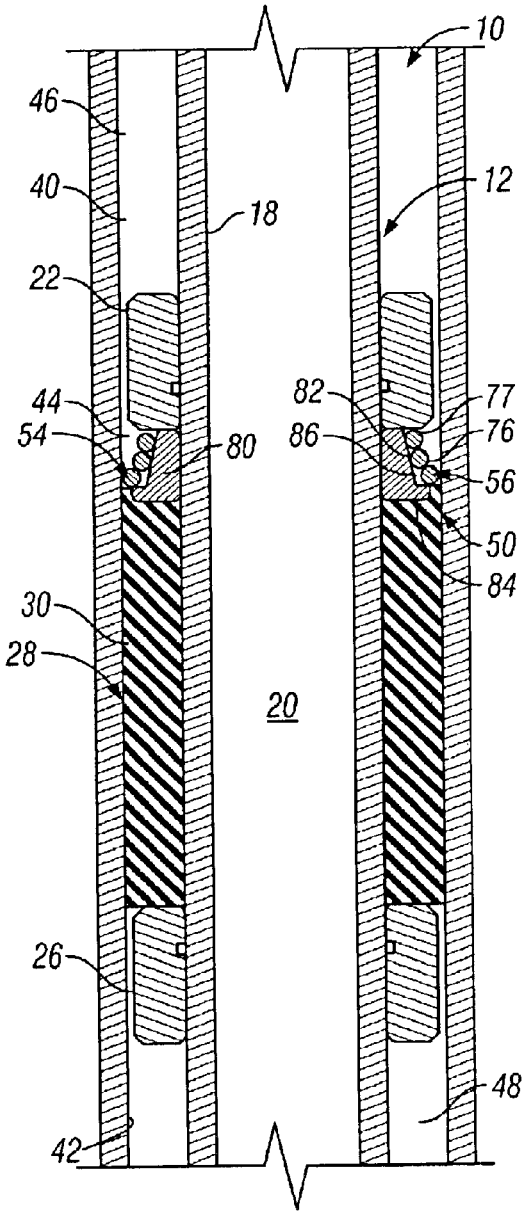
FIG. 7 is a partial cross-sectional view of the embodiment of FIG. 6 showing the expandable member in an expanded position.

FIGS. 6 and 7 illustrate another embodiment of an anti-extrusion device 50 in accordance with the present invention. In this example, the expandable member 54 is a compression spring 76 used with a cone-shaped ring 80 that is disposed around the inner mandrel 18. The ring 80 includes a ramp-shaped, or angled, surface 82 upon which the compression spring 76 is disposed and a shoulder 84 engageable with the elastomeric member 30.

When deploying the packer 12 of this embodiment, generally axial forces placed upon the compression spring 76 push the spring 76 along the ramped surface 82 of the ring 80. The first coil 86 of the spring 76 partially unwinds and the outer diameter of the spring 76 is forced to expand into the extrusion gap 44. Also, the expanded spring 76 places forces upon the ring shoulder 84, which, in turn, maintains generally axial force upon the elastomeric member 30 to assist in retaining it in a set, or sealingly engaged, position during use. Upon removal of axial forces on the exemplary compression spring 76, the spring 76 returns to its nominal, or non-expanded, state enabling movement of the tool 10 and redeployment of the expandable member 54.

The compression spring 76 and ring 80 may, if desired, be sized to achieve the desired expansion of the spring 76. For example, the compression spring 76 may be formed with a relatively small length and its spring element 77 tightly wound. For another example, the angled surface 82 of the ring 80 may have a specific desired angle, such as approximately thirty degrees (30°). For still a further example, the combined size of the largest diameter of the ring 80 along its surface 82 and twice the diameter of the compression spring element 77 may be specifically selected to cause the compression spring 76 to extend into the extrusion gap 44 to a desired, or pre-determined, extent. Other than as described above, the characteristics, capabilities, and operation of this embodiment of the anti-extrusion device 50 may, if desired, be generally similar to those described above for the embodiment of FIGS. 2 and 3.

Figure 8:
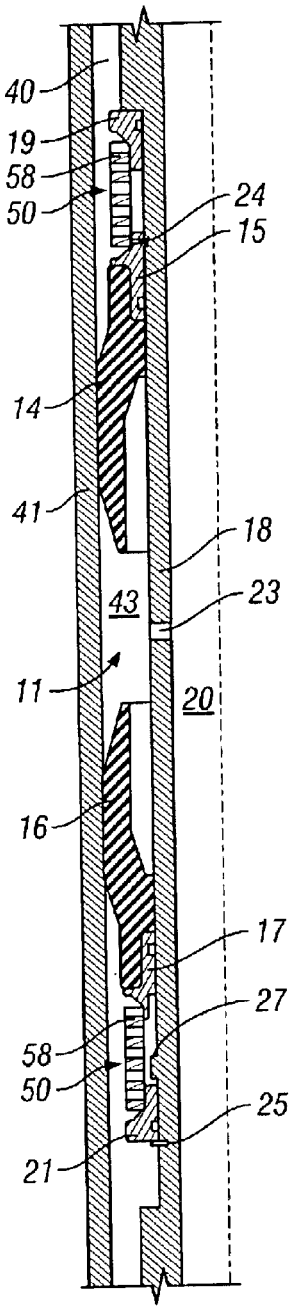
FIG. 8 is a partial cross-sectional view of another embodiment of an anti-extrusion device having a wave spring form of expandible member in accordance with the present invention shown in use with cup packers in a straddle arrangement while running into a cased borehole.

Referring now to FIG. 8, the anti-extrusion device 50 of the present invention is illustrated in use with cup packers on a straddle tool 11 such as is used for isolating a borehole interval for treatment. The straddle tool 11 comprises an upper cup packer 14 and a lower cup packer 16 mounted on the inner mandrel 18 by means of mounting rings 15 and 17, respectively. The wave springs 58 of the anti-extrusion device 50 associated with each cup packer are mounted between the respective mounting ring 15, 17 and a backup ring 19, 21. When the straddle tool 11 is run into the borehole 40, in the example illustrated in FIG. 8 a borehole 40 having a casing 41 therein, the wave springs 58 are uncompressed so as to pass easily through the casing 41. The mounting ring 15 of the upper cup packer 14 is secured to the mandrel 18 by a shear member 24, which may, for example, be in the form of a shear pin or pins, or a shear ring. The backup ring 21 associated with lower cup packer 16 is likewise secured against movement along mandrel 18 by a shear member 25, which may also, for example, be in the form of a shear pin or pins, or a shear ring.

Figure 9:
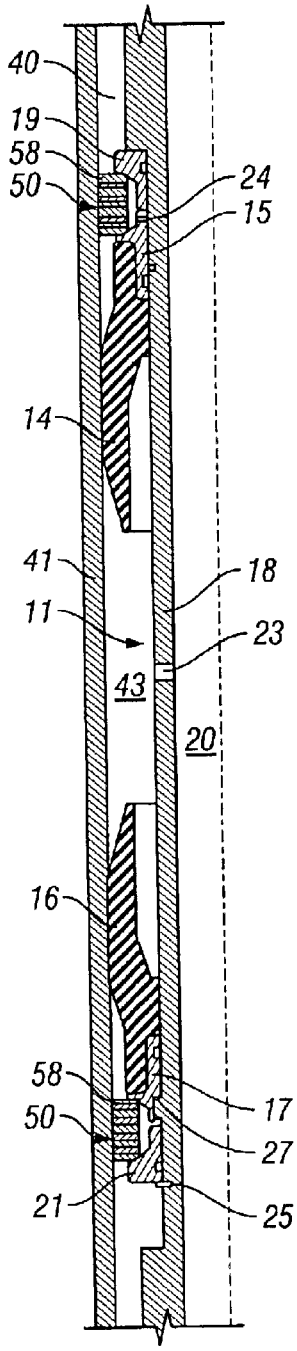
FIG. 9 is a partial cross-sectional view of the embodiment of FIG. 8 shown with the cup packers energized by pressure in the straddled interval.

Referring now to FIG. 9, once the straddle tool 11 has been positioned at the proper depth in the borehole 40, the borehole interval 43 straddled by the packers 14, 16 may be treated by pressurized fluid injected into the borehole interval 43 from the conduit 20 inside mandrel 18 through a port or ports 23. The pressurized fluid entering the borehole interval 43 forces the packers 14, 16 apart and seats them against the casing 41 forming a seal therewith. The force created by the pressurized fluid in the borehole interval 43 causes the shear pin or pins 24 to shear, allowing movement of the packer 14 along the mandrel 18 to compress the wave springs 58 of the anti-extrusion device 50. Likewise, pressurization of the borehole interval 43 causes packer 16 to move along the mandrel 18 until its mounting ring 17 seats against shoulder 27 on mandrel 18 thereby compressing the wave springs 58 of the anti-extrusion device 50 associated therewith.

Figure 10:
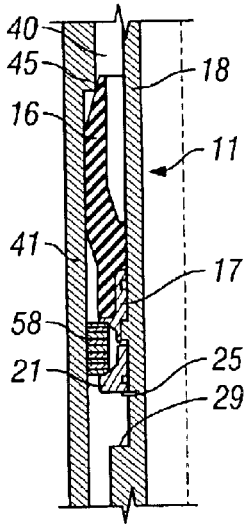
FIG. 10 is a partial cross-sectional view of the lower cup packer and anti-extrusion device of the embodiment of FIGS. 8 and 9 as it encounters a restricted diameter section in the cased borehole.

Once treatment of the borehole interval 43 is complete, the interval 43 is depressurized in preparation for removal of the straddle tool 11 from the borehole 40. As illustrated in FIG. 10, the wave springs 58 will generally remain in the compressed state, thereby presenting an obstruction to removal of the straddle tool 11 when the lower cup packer 16 encounters a restricted diameter section 45, such as a nipple, in the casing 41. When this occurs, the force created by the restricted diameter section 45 against the compressed wave springs 58 causes the shear pin or pins 25 to shear, allowing the wave springs 58 to relax until the backup ring 21 seats against the shoulder 29 in the mandrel 18.

Figure 11:
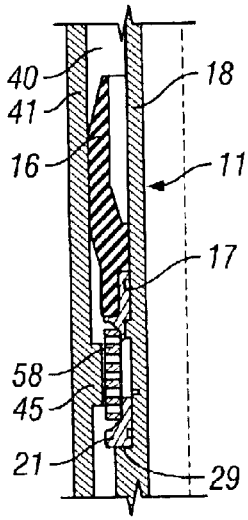
FIG. 11 is a partial cross-sectional view of the lower cup packer and anti-extrusion device of FIG. 10 as the anti-extrusion device passes through the restricted diameter section in the cased borehole.

As illustrated in FIG. 11, the straddle tool 11 can then pass through the restricted diameter section 45 of the casing 41.

The present invention includes additional features, capabilities, functions, methods, uses and applications that have not been specifically addressed herein but are, or will become, apparent from the description herein, the appended drawings and claims. Preferred embodiments of the present invention thus offer advantages over the prior art and are well adapted to carry out one or more of the objects of the invention.

It should be understood that the present invention does not require each of the techniques or acts described above. Moreover, the present invention is in no way limited to the above methods. Further, the methods described above and any other methods which may fall within the scope of any of the appended claims can be performed in any desired suitable order and are not necessarily limited to the order described herein or listed in the appended claims. Yet further, the methods of the present invention do not require use of the particular embodiments shown and described in the present specification, such as, for example, the expandable member 54 of FIGS. 2–7, but are equally applicable with any other suitable structure, form and configuration of components.

Also, it should be understood that the present invention does not require all of the above features and aspects. Any one or more of the above features or aspects may be employed in any suitable configuration without inclusion of other such features or aspects. Further, while preferred embodiments of this invention have been shown and described, many variations, modifications and/or changes of the apparatus and methods of the present invention, such as in the components, details of construction and operation, arrangement of parts and/or methods of use, are possible, contemplated by the patentee, within the scope of the appended claims, and may be made and used by one of ordinary skill in the art without departing from the spirit or teachings of the invention and scope of the appended claims. All matter herein set forth or shown in the accompanying drawings should thus be interpreted as illustrative and not limiting. Accordingly, the scope of the invention and the appended claims is not limited to the embodiments described and shown herein.

What is claimed is:

1. An apparatus useful for discouraging the extrusion of a deformable member of a device into a space located on at least one side of the deformable member when the device is disposed within a borehole, the deformable member extending between the device and the borehole wall and engaging the borehole wall, the apparatus comprising:

an annular expandable member disposed on the device, said annular expandable member being movable between at least one radially non-expanded position and at least one radially expanded position; wherein said annular expandable member in at least one said radially expanded position is capable of reducing the width of the space on at least one side of the deformable member; wherein said at least one annular expandable member includes at least one wave spring.

2. The apparatus of claim 1, wherein in at least one said radially expanded position said annular expandable member is capable of asserting forces to assist in maintaining the deformable member in engagement with the borehole wail.

3. The apparatus of claim 1, wherein in at least one said radially non-expanded position said annular expandable member is deliverable into and removable from the borehole without obstructing movement of the device within the borehole.

4. The apparatus of claim 1, wherein said annular expandable member includes at least one spring-acting member.

5. The apparatus of claim 4, wherein the deformable member is an elastomeric seal.

6. The apparatus of claim 5, wherein the device is a retrievable packer.

7. The apparatus of claim 6, wherein said annular expandable member is located adjacent to and up-hole of the deformable member.

8. The apparatus of claim 1, further including a load ring associated with said annular expandable member and capable of asserting force upon the deformable member to maintain the deformable member in engagement with the borehole wall.

9. The apparatus of claim 1, wherein said annular expandable member is connected with the deformable member.

10. The apparatus of claim 1, wherein said annular expandable member is separate from the deformable member.

11. The apparatus of claim 10, further including a plurality of annular expandable members positioned on at least one among opposing sides of the deformable member.

12. The apparatus of claim 1, further including a mandrel upon which the deformable member and said annular expandable member are carried, and a centralizer associated with said annular expandable member, said centralizer capable of maintaining said annular expandable member generally centered on said mandrel.

13. The apparatus of claim 1, further including a flexible cover within which said annular expandable is disposed.

14. An apparatus useful for discouraging the extrusion of a deformable member of a device into a space located on at least one side of the deformable member when the device is disposed within a borehole, the deformable member extending between the device and the borehole wall and engaging the borehole wall, the apparatus comprising:

an annular expandable member disposed on the device, said annular expandable member having a continuous surface and being movable between at least one radially non-expanded position and at least one radially expanded position, said annular expandable member including at least one spring-acting member; wherein said annular expandable member in at least one said radially expanded position is capable of reducing the width of the space on at least one side of the deformable member, further including a ramped ring upon which said at least one spring-acting member is movable between at least one said radially non-expanded position and at least one said radially expanded position.

15. The apparatus of claim 14, wherein said at least one spring-acting member includes at least one compression spring.

16. The apparatus of claim 14, further including a load ring associated with said annular expandable member and capable of asserting force upon the deformable member to maintain the deformable member in engagement with the borehole wall.

17. An apparatus useful for discouraging the extrusion of a deformable member of a device into a space located on at least one side of the deformable member when the device is disposed within a borehole, the deformable member extending between the device and the borehole wall and engaging the borehole wall, the apparatus comprising:

an annular expandable member disposed on the device, said annular expandable member being movable between at least one radially non-expanded position and at least one radially expanded position; wherein said annular expandable member in at least one said radially expanded position is capable of reducing the width of the space on at least one side of the deformable member; wherein said at least one spring-acting member includes at least one bellville washer.

18. An apparatus useful for discouraging the extrusion of a deformable member of a device into a space located on at least one side of the deformable member when the device is disposed within a borehole, the deformable member extending between the device and the borehole wall and engaging the borehole wall, the apparatus comprising:

an annular expandable member disposed on the device, said annular expandable member being movable between at least one radially non-expanded position and at least one radially expanded position; wherein said annular expandable member in at least one said radially expanded position is capable of reducing the width of the space on at least one side of the deformable member and, said annular expandable member is integral with the deformable member.

19. The apparatus of claim 18, wherein said annular expandable member is a spring-acting member.

20. An anti-extrusion apparatus useful for reducing the width of an extrusion gap adjacent to a seal member of a downhole device deployed in a borehole, the seal member extending between the downhole device and the borehole wall, the anti-extrusion apparatus comprising:

a redeployable spring-acting member disposed on the downhole device, said spring-acting member being movable between a radially non-expanded position and a radially expanded position;

said spring-acting member in said radially expanded position being capable of reducing the width of the extrusion gap on at least one side of the seal member and imparting force to assist in maintaining the seal member in engagement with the borehole wall; and said spring-acting member in said radially non-expanded position being movable within the borehole without obstructing movement of the downhole device; wherein said spring-acting member includes at least one wave spring.

21. The anti-extrusion apparatus of claim 20, further including a load ring associated with said spring-acting member and capable of asserting force upon the seal member to maintain the seal member in engagement with the borehole wall.

22. The anti-extrusion apparatus of claim 21, wherein said spring-acting member in said radially expanded position has a continuous outer surface proximate to the seal member.

23. The anti-extrusion apparatus of claim 22, further including a flexible cover within which said spring-acting member is disposed.

24. The anti-extrusion apparatus of claim 20, further including a ramped ring upon which said spring-acting member is movable between said radially non-expanded position and said radially expanded position.

25. The anti-extrusion apparatus of claim 20, wherein the seal member is an elastomeric seal and the downhole device is a packer.

26. The anti-extrusion apparatus of claim 25, further including at least two said spring-acting members.

27. A downhole tool capable of sealing an annulus formed between the downhole tool and a borehole wall, there being a potential pressure differential in the annulus, the downhole tool comprising:

an inner mandrel deployable into the borehole;

at least one elastomeric member carried upon said inner mandrel, said at least one elastomeric member being extendable from the downhole tool and sealingly engageable with the borehole wall;

at least one annular expandable member carried upon said inner mandrel, said at least one annular expandable member including a wave spring, said at least one annular expandable member being extendable into the annulus around the circumference of the downhole tool to reduce the width of the annulus adjacent to said at least one elastomeric member and discourage extrusion of said at least one elastomeric member therein, said at least one annular expandable member further being capable of asserting forces to assist in maintaining said at least one elastomeric member in sealing engagement with the borehole wall;

said at least one annular expandable member being retractable from the annulus to allow movement of the downhole tool within the borehole; and said at least one annular expandable member being redeployable.

28. The downhole tool of claim 27, wherein said at least one annular expandable member has a continuous outer surface, whereby said at least one elastomeric member will not extrude into said at least one annular expandable member.

29. The downhole tool of claim 28, further including a flexible cover within which said annular expandable member is disposed.

30. The downhole tool of claim 27, wherein the differential pressure in the annulus across said elastomeric member when sealingly engaged with the borehole wall is at least approximately 6000 psi.

31. A method for discouraging the extrusion of a seal member of a device into an annulus formed between the device and the wall of a borehole, the seal member extendable from the device across the annulus and sealingly engageable with the borehole wall, the device also carrying an annular expandable member, the method comprising:

applying compressive force to the annular expandable member, causing the annular expandable member to extend along a ramped ring into and reduce the width of the annulus on at least one side of the seal member around the circumference of the device;

the annular expandable member asserting generally axially-oriented force to assist in maintaining the seal member in engagement with the borehole wall; and removing compressive force from the annular expandable member, causing the annular expandable member to retract along a ramped ring from the annulus, allowing movement of the device within the borehole and redeployment of the annular expandable member and seal member.

32. The method of claim 31, further including repositioning the device in the borehole, and redeploying the seal member and the annular expandable member.

33. The method of claim 31, further including removing the device from the borehole, inserting the device into a second borehole, and redeploying the seal member and the annular expandable member in the second borehole.

34. A downhole tool for sealing against a borehole wall, comprising:

a mandrel;

a packer slidably mounted on said mandrel; and an annular continuous expandable anti-extrusion member disposed on said mandrel, said anti-extrusion member being movable between at least one radially non-expanded position and at least one radially expanded position, and engaged between said packer and an element slidably mounted on said mandrel, wherein said element is restrained against movement by a shear member.

35. The downhole tool of claim 34, wherein said packer is a cup packer.

36. The downhole tool of claim 34, wherein said shear member comprises at least one shear pin.

37. A downhole tool for sealing against a borehole wall, comprising:

a mandrel;

a packer slidably mounted on said mandrel; and an annular continuous expandable anti-extrusion member disposed on said mandrel, said anti-extrusion member being movable between at least one radially non-expanded position and at least one radially expanded position, and engaged between said packer and said mandrel;

wherein said packer is restrained against movement by a shear member.

38. The downhole tool of claim 37, wherein said packer is a cup packer.

39. The downhole tool of claim 37, wherein said shear member comprises at least one shear pin.

40. The downhole tool of claim 37, wherein said shear member is sheared when said anti-extrusion member is moved to said at least one radially expanded position.

* * * * *